US008231358B2

(12) United States Patent
Cho

(10) Patent No.: US 8,231,358 B2
(45) Date of Patent: Jul. 31, 2012

(54) VACUUM EJECTOR PUMPS

(75) Inventor: Ho-Young Cho, Seoul (KR)

(73) Assignee: Korea Pneumatic System Co., Ltd. (KR)

( * ) Notice: Subject to any disclaimer, the term of this patent is extended or adjusted under 35 U.S.C. 154(b) by 869 days.

(21) Appl. No.: 12/087,230

(22) PCT Filed: Dec. 21, 2006

(86) PCT No.: PCT/KR2006/005638
§ 371 (c)(1),
(2), (4) Date: Jun. 27, 2008

(87) PCT Pub. No.: WO2007/078077
PCT Pub. Date: Jul. 12, 2007

(65) Prior Publication Data

US 2008/0292476 A1 Nov. 27, 2008

(30) Foreign Application Priority Data

Dec. 30, 2005 (KR) ..... 10-2005-0135042

(51) Int. Cl.
*F04F 5/20* (2006.01)
*F04F 5/44* (2006.01)

(52) U.S. Cl. ..... 417/187; 417/163; 417/165; 417/166; 417/169; 417/189

(58) Field of Classification Search ..... 417/163, 417/165, 166, 169, 187, 189
See application file for complete search history.

(56) References Cited

U.S. PATENT DOCUMENTS

| | | | |
|---|---|---|---|
| 4,395,202 | A | 7/1983 | Tell |
| 4,466,778 | A | 8/1984 | Volkmann |
| 4,759,691 | A | 7/1988 | Kroupa |
| 4,790,054 | A | 12/1988 | Nichols |
| 4,880,358 | A | 11/1989 | Lasto |

(Continued)

FOREIGN PATENT DOCUMENTS

KR 10-2004-0059067 * 7/2004

OTHER PUBLICATIONS

International Search Report & Written Opinion for PCT/KR2006/005638.

*Primary Examiner* — Devon Kramer
*Assistant Examiner* — Dominick L Plakkoottam
(74) *Attorney, Agent, or Firm* — Vic Y. Lin; Innovation Capital Law Group, LLP

(57) ABSTRACT

Disclosed herein is a vacuum ejector pump. The pump is operated by compressed air which is supplied to or discharged from the pump at high speed, thus creating negative pressure in an outer surrounding space. The ejector pump includes a frame having an air inlet pipe, a disc, and an air outlet pipe which are sequentially arranged to be spaced apart from each other. The parts are coupled into a single structure via a spacer. A nozzle is mounted to pass through the center of the disc, and a flexible valve member is mounted to the spacer A nozzle body is accommodated in a cylindrical casing having a hole at a position corresponding to the valve member, and defines a chamber inside the spacer. A locking structure is provided on the casing and the nozzle body so as to prevent the casing, which accommodates the nozzle body, from rotating.

10 Claims, 10 Drawing Sheets

U.S. PATENT DOCUMENTS 5,169,293 A 12/1992 Yamamoto
5,228,839 A 7/1993 Peterson et al.
5,683,227 A * 11/1997 Nagai et al. ..... 417/174
6,394,760 B1 5/2002 Tell
6,582,199 B1 * 6/2003 Volkmann ..... 417/178
6,585,695 B1 * 7/2003 Adair et al. ..... 604/183
7,438,535 B2 * 10/2008 Morishima ..... 417/187
2007/0148009 A1 * 6/2007 Cho ..... 417/174

* cited by examiner

[Fig. 1]
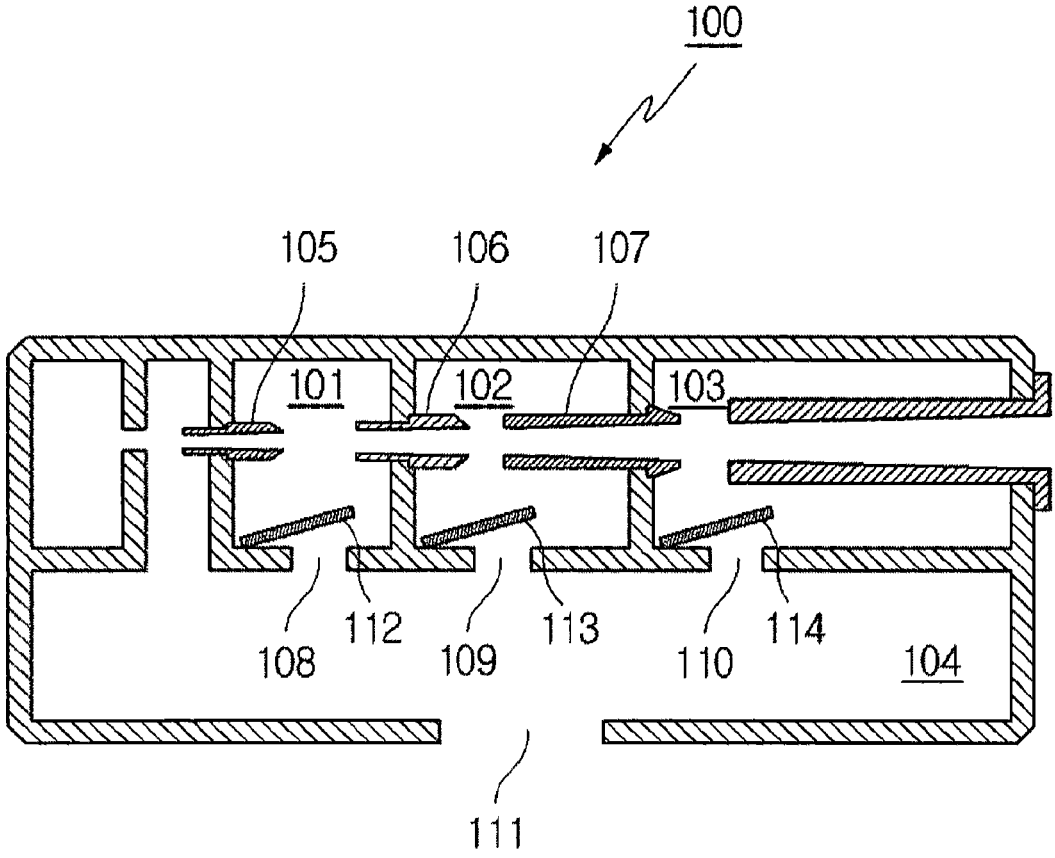

[Fig. 2]
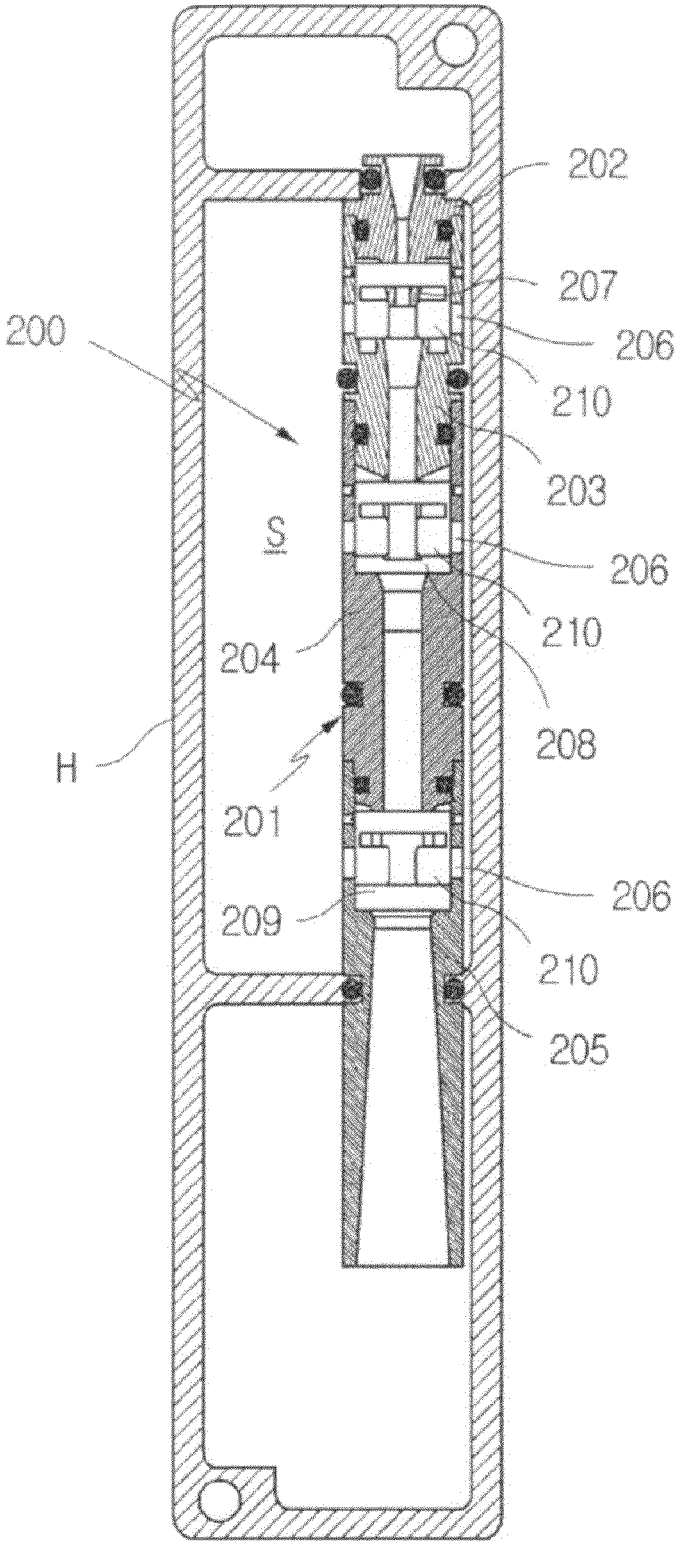

[Fig. 3]
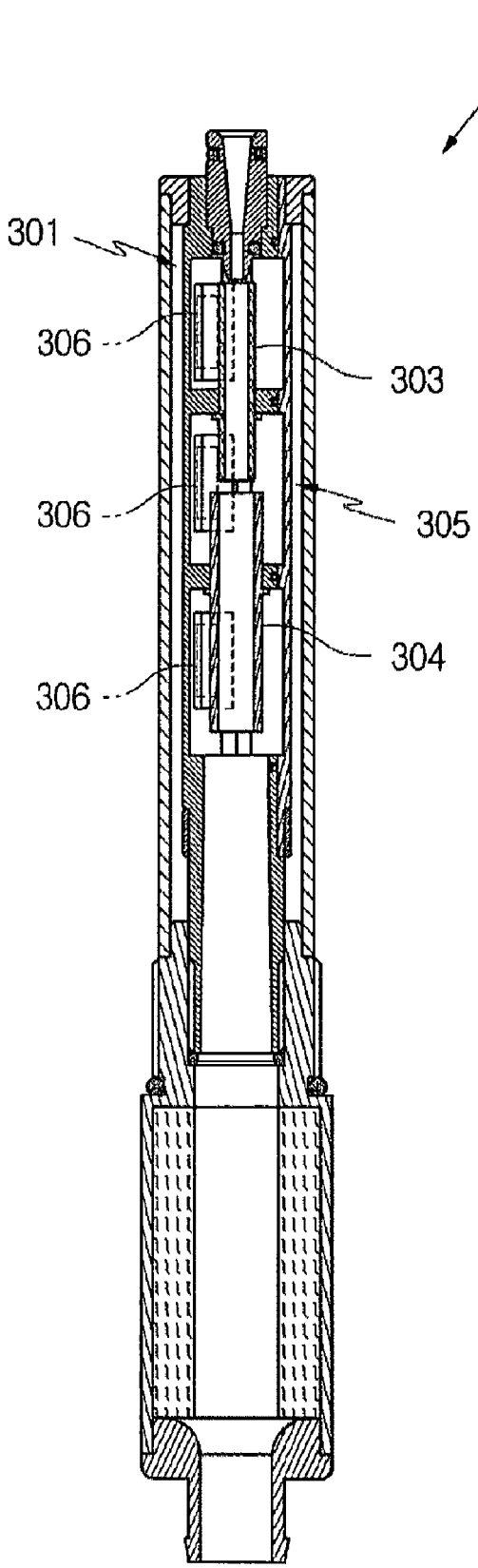

[Fig. 4]
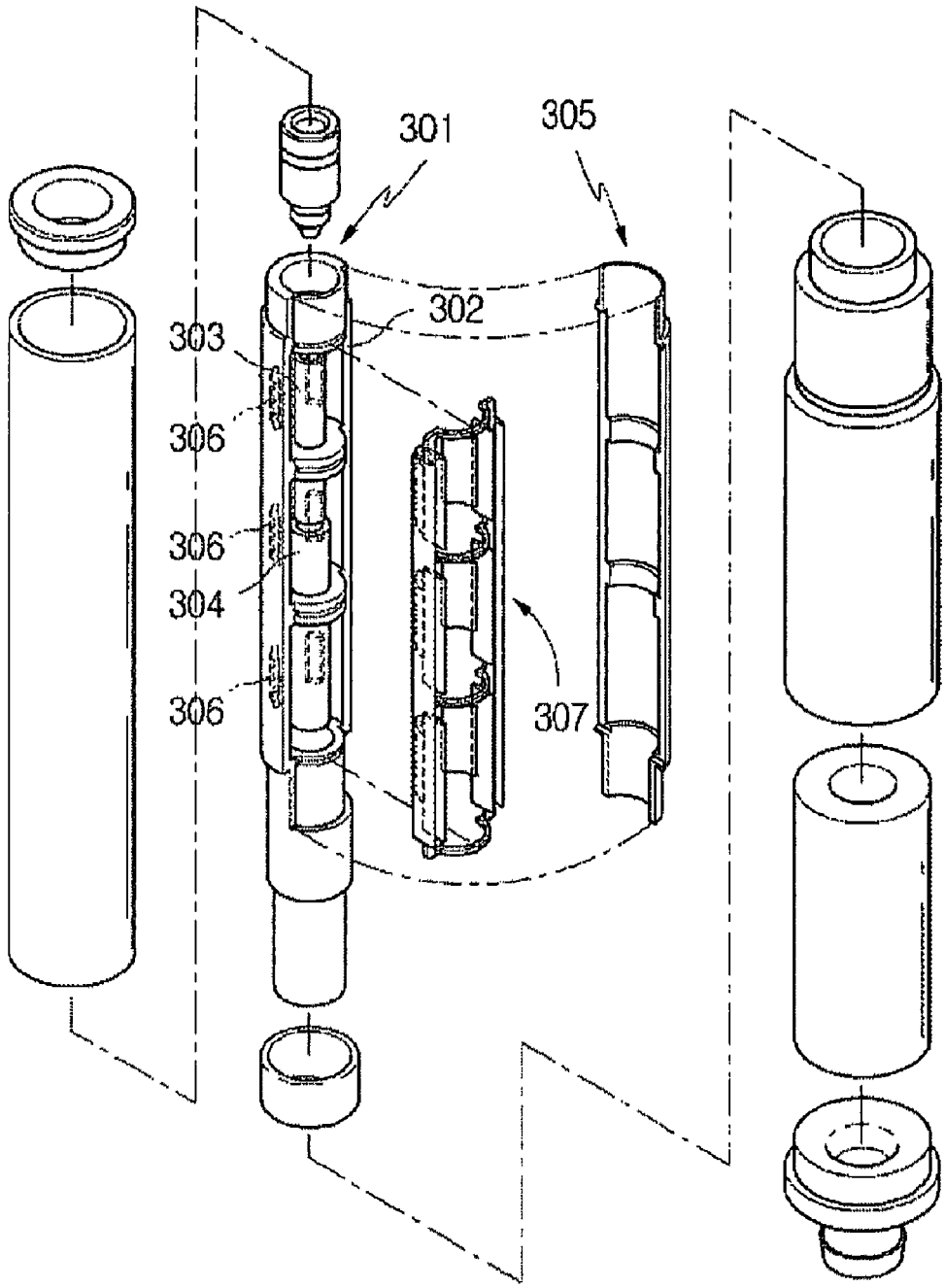

[Fig. 5]
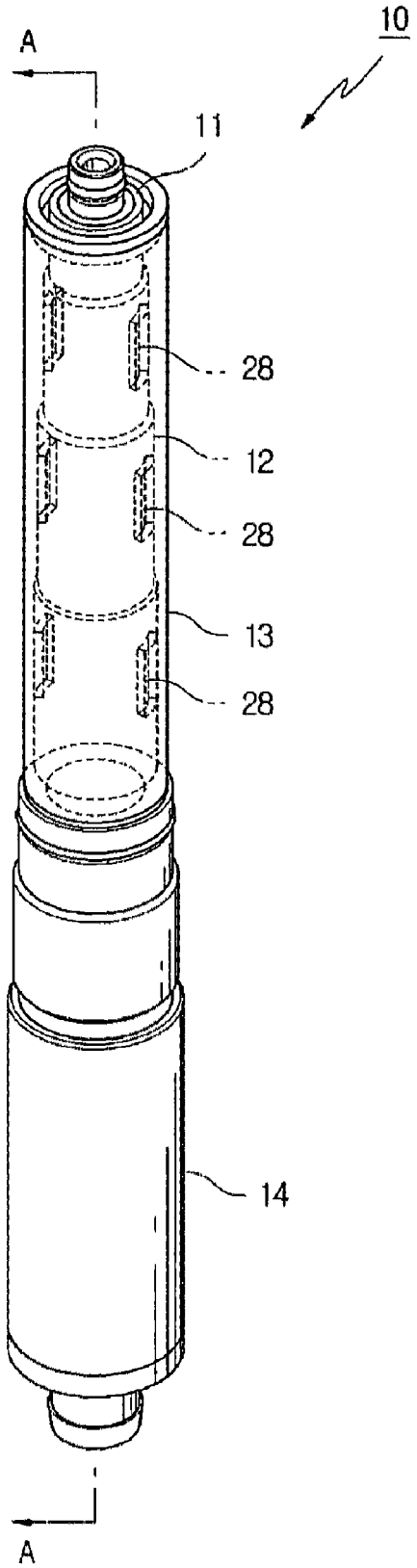

[Fig. 6]
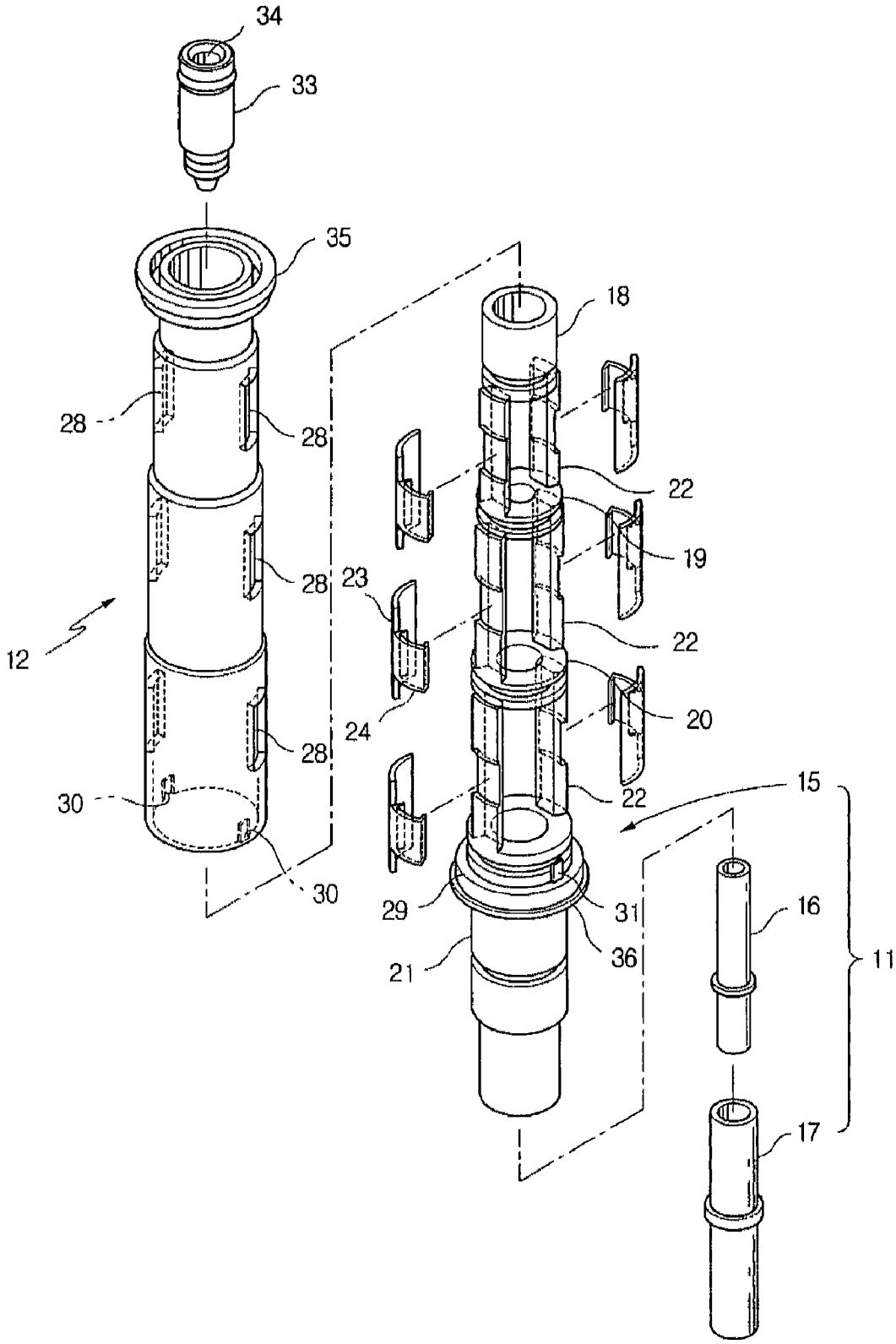

[Fig. 7]
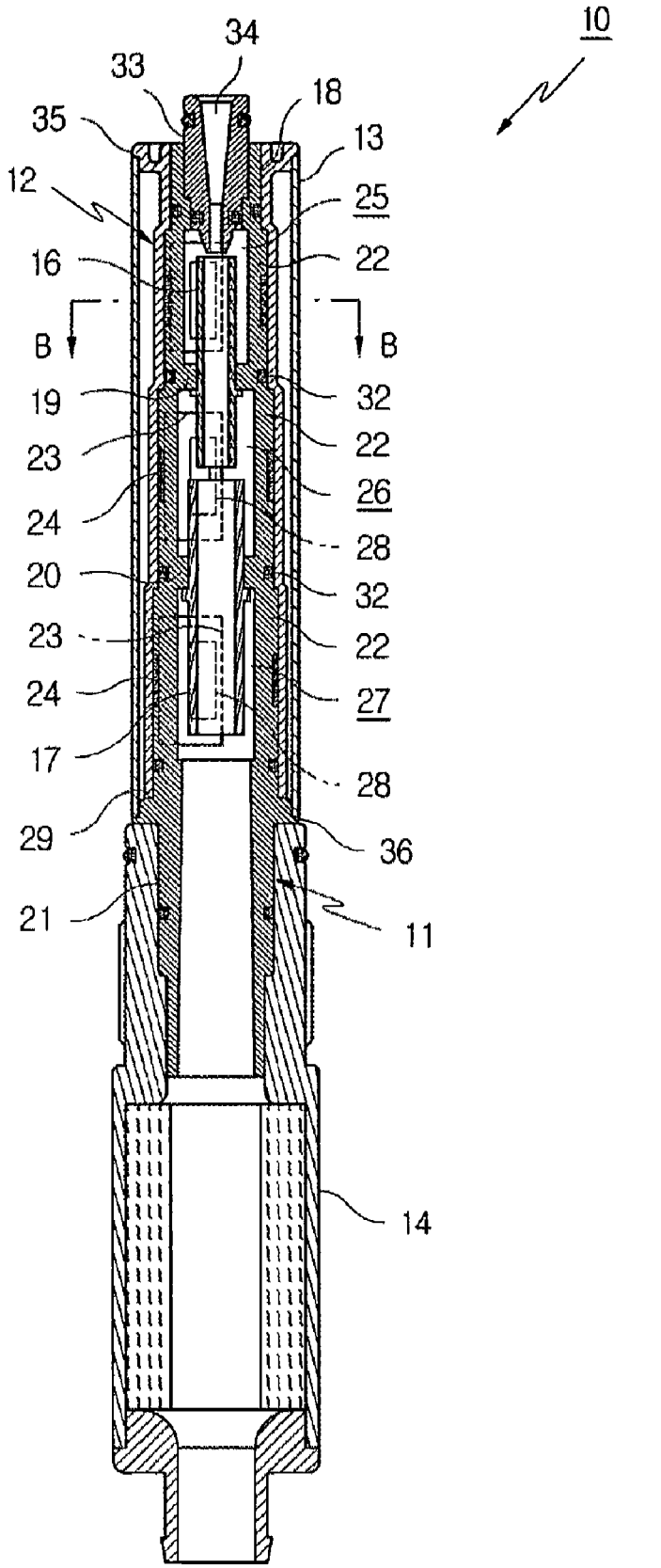

[Fig. 8]
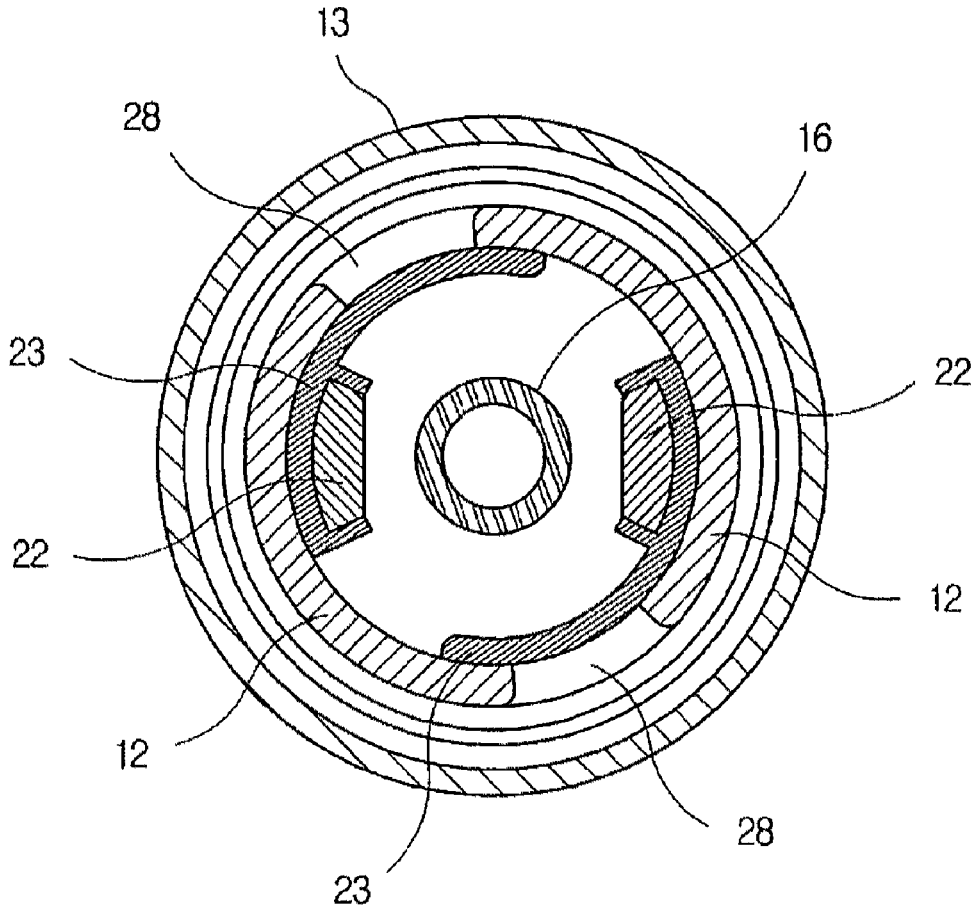

[Fig. 9]
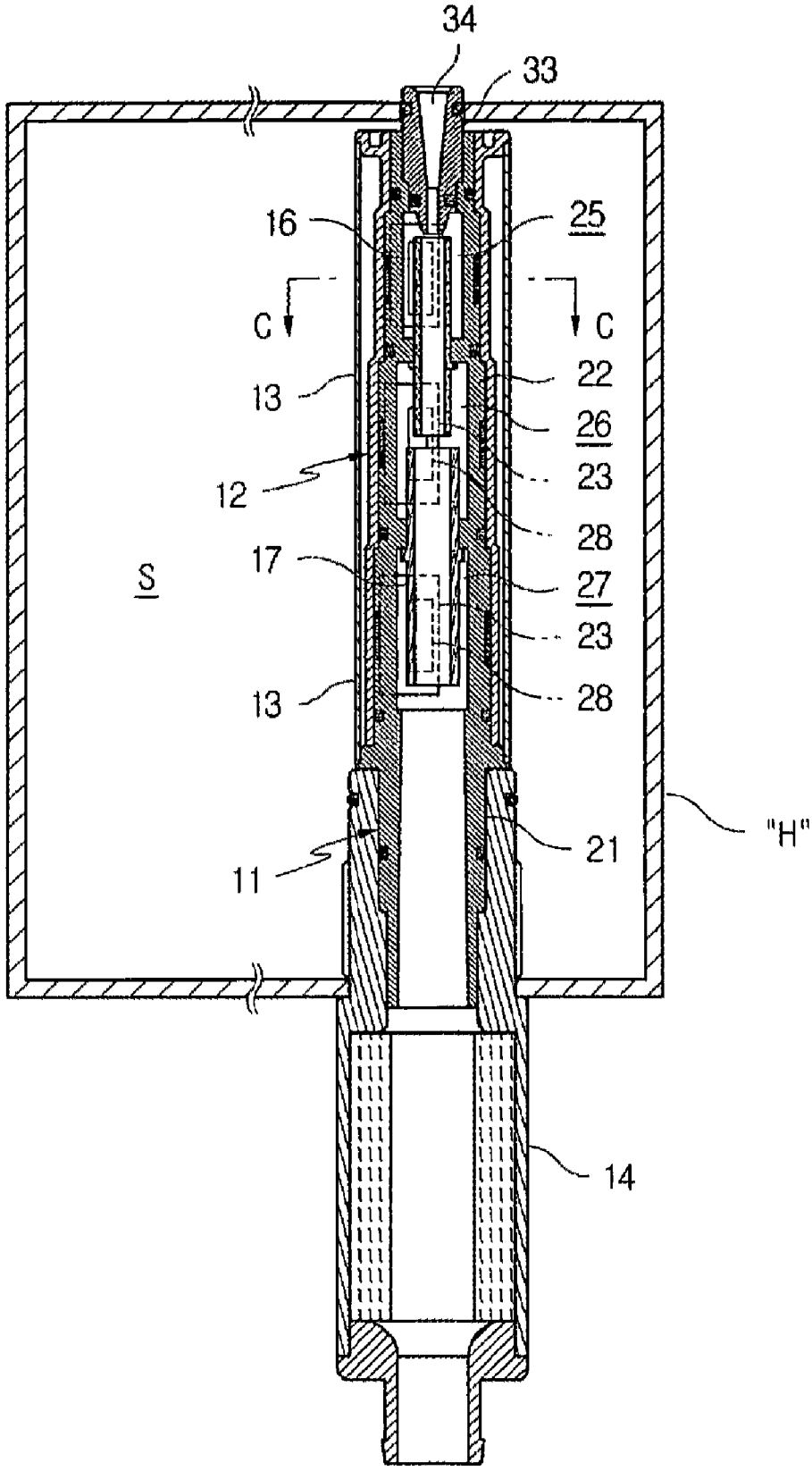

[Fig. 10]
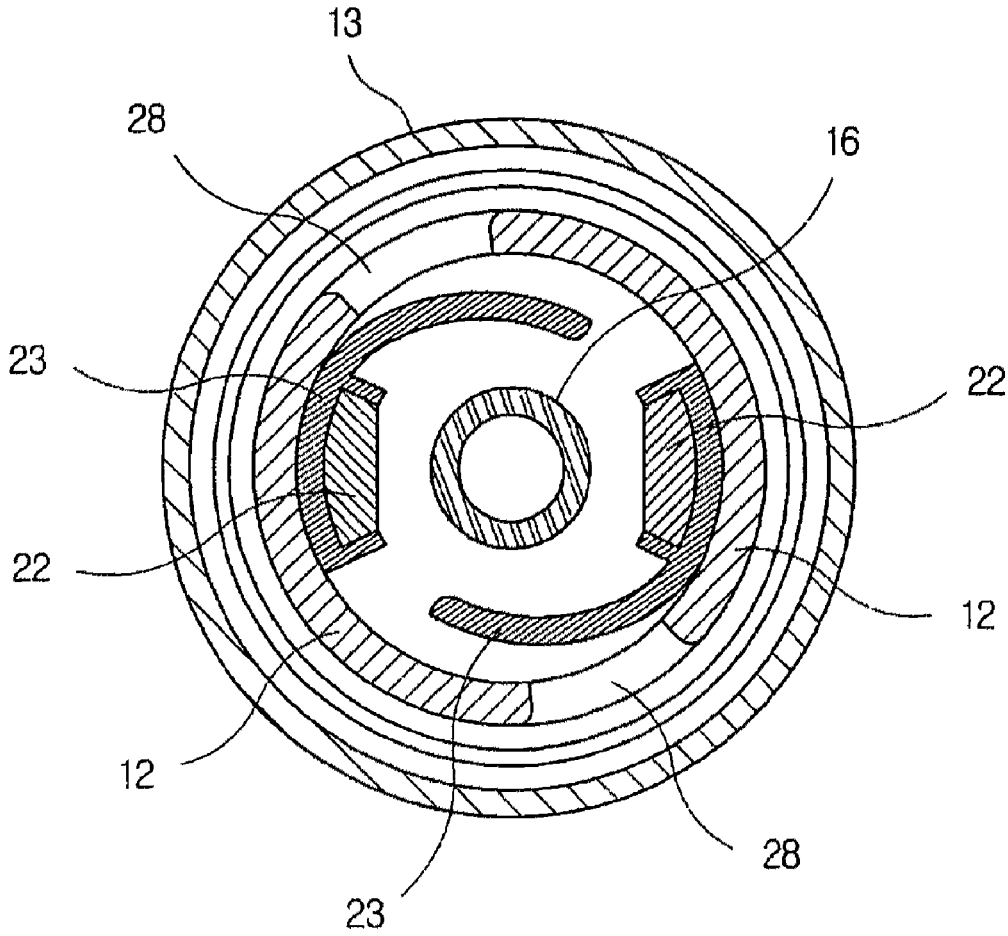

VACUUM EJECTOR PUMPS

TECHNICAL FIELD

The present invention relates, in general, to ejector pumps and, more particularly, to a vacuum ejector pump which is operated using compressed air that is supplied to and discharged from the pump at high speed, thus creating negative pressure in a certain space.

A typical vacuum pump, which is known as so-called 'multi-stage ejector', is shown in FIG. 1. Such a vacuum pump 100 includes chambers 101, 102, and 103 which are arranged in series, and a plurality of nozzles 105, 106, and 107 which are mounted to pass through partition walls between the chambers 101, 102, and 103. Each of the chambers 101, 102, and 103 communicates with a common vacuum chamber 104 via a hole 108, 109, or 110. The vacuum pump 100 is connected to an external device (e.g. suction device) through a port 111 which is formed at a predetermined position in the vacuum chamber 104. When compressed air is discharged through the nozzles 105, 106, and 107 at high speed, air present in the vacuum chamber 104 and the external device is also discharged, so that the pressure in the vacuum chamber 104 drops. When the pressure in the vacuum chamber 104 becomes lower than the pressure of each chamber 101, 102, or 103, all of the holes 108, 109, and 110 are closed by corresponding valves 112, 113, and 114. The vacuum chamber 104 maintains the pressure level. Through this process, negative pressure is created in the external device. The negative pressure thus created is used to convey an article. Meanwhile, such a vacuum pump 100 is problematic in that it cannot be directly installed in a device which is to be evacuated. Further, the vacuum pump is problematic in that it is difficult to disassemble and assemble the vacuum pump to conduct repairs and maintenance.

BACKGROUND ART

In order to solve the problems of the above-mentioned vacuum pump 100, a vacuum pump, which is disclosed in Korean Patent No. 393434 (which corresponds to U.S. Pat. No. 6,394,760), is shown in FIG. 2. According to the cited document, the vacuum pump 200 includes a plurality of nozzles 202, 203, 204, and 205 which are arranged in series and have slots 207, 208, and 209 between the nozzles, and valve members 210 which are provided between the nozzles and close or open communication holes 206 formed in walls of the respective nozzles. Further, a coupling means for coupling each nozzle to an integrated, rotationally symmetric nozzle body 201 is provided on each nozzle. The vacuum pump 200 is directly accommodated in a housing H of another device, and is operated by compressed air which sequentially passes through the nozzles at high speed, thus creating negative pressure in the internal space S of the housing H. However, the vacuum pump 200 is problematic in that connection parts between the nozzles are apt to be deformed (bent or twisted) or separated from each other by external force or shocks.

Another conventional vacuum pump, which was proposed by the applicant of this invention in order to overcome the drawback of the above vacuum pump 200, and is disclosed in Korean U.M. Registration No. 365830, is shown in FIGS. 3 and 4. According to the cited document, the vacuum pump 300 includes a cylindrical nozzle body 301, a cover 305, and a flexible valve member 307. An opening 302 is formed at a predetermined position in the nozzle body, and a plurality of nozzles 303 and 304 is installed in the nozzle body. The cover closes the opening 302. The valve member is provided to open or close several holes 306 which are formed in a wall of the nozzle body 301. In the vacuum pump 300, each nozzle is safely held in the cylindrical nozzle body. However, the vacuum pump is problematic in that the number of required parts is very high, so that it is difficult and inconvenient to produce and assemble the vacuum pump, and the vacuum pump is weakly resistant to external shocks. Further, the valve member must be skillfully designed such that it is secured to an edge of the opening of the nozzle body and extends along the holes. Thus, it is very difficult to manufacture and mount the valve member.

DISCLOSURE OF INVENTION

Technical Problem

Accordingly, the present invention is an improvement on the invention of the vacuum pump 300 which was proposed by the applicant of this invention and disclosed in Korean U.M. Registration No. 365830. An object of the present invention is to provide a vacuum ejector pump, which can be directly installed in a device to be evacuated. Another object of the present invention is to provide a vacuum ejector pump, which can be conveniently assembled and produced, and is reinforced to resist breakage and damage when it is in use.

Technical Solution

In order to accomplish the objects, the present invention provides a vacuum ejector pump, including: a nozzle body having a frame having an air inlet pipe, discs, and an air outlet pipe which are sequentially arranged to be spaced apart from each other, and integrally coupling the air inlet pipe, the discs, and the air outlet pipe to each other using spacers, and nozzles mounted to pass through centers of the corresponding discs; flexible valve members mounted to the spacers; a cylindrical casing having a hole formed at a position corresponding to each valve member, and accommodating the nozzle body such that the nozzle body is in close contact with the casing, thus defining a chamber inside the spacers; and a locking structure provided on the casing and the nozzle body so as to prevent the casing, accommodating the nozzle body, from rotating. Preferably, an inner diameter of the casing increases in stages.

The assembly of the vacuum ejector pump is completed by mounting the valve members to the nozzle body, and fitting the nozzle body, equipped with the valve members, into the casing. The chambers communicate with each other via the nozzles mounted to the discs, and communicate with the exterior or with the surrounding space via the holes. The opening and closing of each hole is controlled by the valve member, which is operated by air pressure.

Advantageous Effects

A vacuum ejector according to the present invention is completed by inserting a nozzle body into a casing. Thus, it is convenient to assemble and produce the vacuum ejector. Further, the vacuum ejector is constructed so that the casing is in close contact with the nozzle body, which is placed in the casing. That is, the vacuum ejector has a double structure in which the nozzle body reinforces the casing. Thus, the vacuum ejector pump is resistant to external shocks. Particularly, even if nozzles, which are arranged along the same axis and spaced apart from each other, slightly deviate from predetermined positions, the vacuum efficiency of the ejector pump is considerably lowered. However, since the vacuum ejector has superior shock resistance, the vacuum ejector reliably maintains the nozzles.

BRIEF DESCRIPTION OF THE DRAWINGS

FIG. 1 is a sectional view of a typical vacuum ejector pump;

FIG. 2 is a sectional view of a conventional vacuum ejector pump;

FIG. 3 is a sectional view of another conventional vacuum ejector pump;

FIG. 4 is an exploded perspective view of FIG. 3;

FIG. 5 is a perspective view showing a vacuum ejector pump, according to an embodiment of the present invention;

FIG. 6 is an exploded perspective view of FIG. 5;

FIG. 7 is a sectional view taken along line A-A of FIG. 5;

FIG. 8 is a sectional view taken along line B-B of FIG. 7;

FIG. 9 is a view showing the state where the vacuum ejector pump according to the present invention is accommodated in an additional housing; and FIG. 10 is a sectional view taken along line C-C of FIG. 9, and showing the state where the surrounding space is evacuated.

DESCRIPTION OF REFERENCE CHARACTERS OF IMPORTANT PARTS

10. vacuum ejector pump
11. nozzle body
12. casing
15. frame
16, 17. nozzles
18. air inlet pipe
19, 20. discs
21. air outlet pipe
22. spacers
23. valve members
25, 26, 27. chambers
28. holes

BEST MODE FOR CARRYING OUT THE INVENTION

The above and other objects, features and advantages of the present invention will be more clearly understood from the following detailed description taken in conjunction with the accompanying drawings.

Referring to FIGS. 5 to 10, a vacuum ejector pump according to the present invention is denoted by reference numeral 10. The ejector pump 10 includes a nozzle body 11 and a cylindrical casing 12 which accommodates the nozzle body 11 therein. Reference numeral 13 denotes a filter, and reference numeral 14 denotes a silencer.

The nozzle body 11 includes a frame 15 and nozzles 16 and 17. The frame 15 includes an air inlet pipe 18, discs 19 and 20, and an air outlet pipe 21, which are sequentially arranged to be spaced apart from each other. The parts 18, 19, 20, and 21 are coupled to each other via spacers 22, thus forming a single structure. The nozzles 16 and 17 are mounted to pass through the centers of the discs 19 and 20. According to this embodiment, there are two discs 19 and 20. However, according to another embodiment, which is not shown in the drawings, three or more discs may be provided.

The nozzles 16 and 17 are fitted into the centers of the corresponding discs 19 and 20, and are arranged in series to be spaced apart from each other, thus providing one nozzle set. According to another embodiment, which is not shown in the drawings, by forming several mounting holes in each of the discs 19 and 20, a plurality of nozzle sets may be provided in parallel.

The spacers 22 are formed on edges of the discs 19 and 20. A pair of spacers is provided on the edge of each disc in such a way that they face each other. In a detailed description, each spacer 22 has a rounded outer surface and a planar inner surface. Particularly, since each spacer 22 has a rounded outer surface, the spacer 22 can be in close contact with the inner surface of the cylindrical casing 12 (see, FIG. 8).

A flexible valve member 23 is mounted to each spacer 22. In a detailed description, the valve member 23 has a part 24 which surrounds and holds each spacer 22. The part 24 is firmly seated in a recess which is formed on the center of each spacer 22. The valve member 23 may be made of a flexible material, for example, natural rubber, synthetic rubber, or urethane rubber.

The cylindrical casing 12 has a hole 28 which is formed at a position corresponding to each valve member 23 (see, FIG. 8). The casing 12 accommodates the nozzle body 11 such that the nozzle body is in close contact with the casing. In a detailed description, the parts 18, 19, 20, 21, and 22 of the nozzle body 11 excluding the nozzles 16 and 17 are in close contact with the inner surface of the casing. Thus, chambers 25, 26, and 27 are defined in spaces surrounded by the spacers 22 of the nozzle body 11. The chambers 25, 26, and 27 communicate with each other via the nozzles 16 and 17 which are mounted to the discs 19 and 20, and communicate with an exterior or a surrounding space via the holes 28. Each hole 28 is opened or closed by an associated valve member 23 which is operated by air pressure. Reference numeral 32 denotes an 'O'-shaped gasket which is provided along an edge of each disk 19 or 20 so as to prevent air from undesirably flowing between the chambers 25, 26, and 27, and is in contact with the inner surface of the casing 12.

The assembly of the ejector pump 10 is completed by mounting the valve members 23 to the nozzle body 11 and then fitting the nozzle body into the casing 12. In order to allow the nozzle body 11 to be easily inserted into the casing 12, preferably, the inner diameter of the casing 12 increases in stages. One end of the casing 12 accommodates an end of the air outlet pipe 21, and is supported by a locking step 29 of the air outlet pipe 21. In order to prevent the rotation of the casing 12, locking holes 30 and locking keys 31, which engage with each other, are formed on the end of the casing 12 and the locking step 29 of the air outlet pipe 21. The locking structure for preventing the rotation of the casing 12 which accommodates the nozzle body 11 may be designed to have various shapes.

Referring to FIG. 7, a jet part 33 having an air jet hole 34 is mounted to the air inlet pipe 18, and the silencer 14 for preventing noise is mounted to the air outlet pipe 21. Further, the cylindrical filter 13, which has a larger diameter than that of the casing 12, receives the casing 12 therein. In such a state, the filter and the casing are coaxially arranged. Referring to the drawing, the filter 13 is supported at both ends thereof to a circular flange 35 of the casing 12 and a circular flange 36 of the air outlet pipe 21. The means or method for supporting the filter 13 may be varied.

FIG. 9 shows the ejector pump 10 according to the present invention, which is accommodated in a housing H. The ejector pump 10 passes through a surrounding space S and is held by both sidewalls of the housing H. In this case, the surrounding space S may communicate with the inner chambers 25, 26 and 27 of the ejector pump 10 via the holes 28.

Air, which is injected into the ejector pump 10 through the air jet part 33, passes through the nozzles 16 and 17 at high speed, and is discharged through the air outlet pipe 21 to the outside. At this time, air present in the surrounding space S is fed through the open holes 28 into the chambers 25, 26, and 27, and is discharged along with compressed air (see, FIG. 10). When the pressure of the surrounding space S starts to drop, and becomes lower than the internal pressure of the ejector pump 10 through the exhaust operation, all of the holes 28 are closed by the corresponding valve members 23, so that the surrounding space S maintains the pressure level.

The invention claimed is:

1. A vacuum ejector pump which is operated by compressed air supplied to or discharged from the pump at high speed, thus creating negative pressure in an outer surrounding space, the vacuum ejector pump comprising: a nozzle body, comprising: a frame having an air inlet pipe, a disc, and an air outlet pipe which are sequentially arranged to be spaced apart from each other, and integrally coupling the air inlet pipe, the disc, and the air outlet pipe to each other using bar-shaped spacers; and a nozzle mounted to pass through a center of the disc; a plurality of flexible valve members, each flexible valve member having a part which surrounds and holds each spacer and be firmly seated in a recess formed on each spacer, and easily mounted to each spacer; a cylindrical casing having a plurality of holes formed at positions corresponding to each valve member, and accommodating the nozzle body such that the nozzle body is in close contact with the casing, thus defining a chamber inside the spacers; and a locking structure provided on the casing and the nozzle body so as to prevent the casing, accommodating the nozzle body, from rotating around the nozzle body; wherein one end of the casing accommodates an end of the air outlet pipe, and is supported by a locking step of the air outlet pipe; and wherein the locking structure comprises a locking hole and a locking key which are formed on the end of the casing and the locking step of the air outlet of the nozzle body, respectively, such that the locking hole and the locking key engage with each other.

2. The vacuum ejector pump according to claim 1, wherein the disc comprises two or more discs, the discs being coupled to each other via the spacers.

3. The vacuum ejector pump according to claim 1 or 2, wherein the nozzle comprises a plurality of nozzles, the nozzles being arranged in series to be spaced apart from each other.

4. The vacuum ejector pump according to claim 1 or 2, wherein each spacer comprises a pair of spacers that face each other.

5. The vacuum ejector pump according to claim 1 or 2, wherein each of the spacers is formed on an edge of the disc, and has a rounded outer surface and a planar inner surface.

6. The vacuum ejector pump according to claim 1, wherein each valve member has a part for surrounding and holding each spacer, and each valve member is firmly seated in a recess which is formed in a center of each spacer.

7. The vacuum ejector pump according to claim 1, wherein an inner diameter of the casing increases in stages.

8. The vacuum ejector pump according to claim 1 or 2, wherein the disc comprises on an edge thereof an 'O'-shaped gasket so as to prevent undesirable flow of air.

9. The vacuum ejector pump according to claim 1, wherein a cylindrical filter and the casing are coaxially arranged, with the filter receiving the casing therein.

10. The vacuum ejector pump according to claim 9, wherein a first end of the casing receives an end of the air outlet pipe, and both ends of the filter are supported by a circular flange formed on a second end of the casing and a circular flange formed on the air outlet pipe.

* * * * *